US006622884B1

(12) United States Patent
Gartner

(10) Patent No.: US 6,622,884 B1
(45) Date of Patent: Sep. 23, 2003

(54) PAINT EDGER TRAY

(75) Inventor: Perry Gartner, Englewood, NJ (US)

(73) Assignee: Brenner International Corp., Englewood, NJ (US)

( * ) Notice: Subject to any disclaimer, the term of this patent is extended or adjusted under 35 U.S.C. 154(b) by 0 days.

(21) Appl. No.: 10/065,964

(22) Filed: Dec. 4, 2002

Related U.S. Application Data

(60) Provisional application No. 60/319,459, filed on Aug. 9, 2002.

(51) Int. Cl.[7] ..... A47G 19/14; B05C 21/00

(52) U.S. Cl. ..... 220/570; 220/697; 220/736; 220/695; 222/572

(58) Field of Search ..... 220/570, 697, 220/736, 695; 222/572; 15/257.06

(56) References Cited

U.S. PATENT DOCUMENTS 551,279 A * 12/1895 Hathaway et al. ..... 470/156
3,837,034 A * 9/1974 Leffert et al. ..... 15/257.06
4,815,604 A * 3/1989 O'Neil et al. ..... 206/518
5,054,661 A * 10/1991 Hollje ..... 222/465.1
5,810,196 A * 9/1998 Lundy ..... 220/736
5,984,129 A * 11/1999 Pasinski ..... 220/570
5,999,772 A * 12/1999 Kakitani et al. ..... 399/125
6,419,106 B1 * 7/2002 Bebak ..... 220/570

* cited by examiner

*Primary Examiner*—Joseph M. Moy
(74) *Attorney, Agent, or Firm*—Richard A. Joel

(57) ABSTRACT

This invention comprises a uniquely shaped small paint tray for edger trimmers and pad painters in general with walls extending upwardly from a base and an inclined distribution portion or ramp extending upwardly from the middle of the base and terminating in an upper ledge at a spaced interval from a rear wall. The distribution ramp includes a plurality of spaced raised chevron shaped ridges that distribute the paint on the edger pad. The ramp terminates at a vertical ledge spaced from the rear wall to wipe paint from the pad, which returns into the tray rather than fouling the end wall. A spout is formed in the rear wall between raised portions of the side and rear walls to save and pour paint that accumulates on the base. Side walls join the forward and rear walls. A cover is provided with channels, which fit over and engage mating channels in the base and include flanges having projecting elements, which engage recesses in the cover in a secure fit.

14 Claims, 2 Drawing Sheets

PAINT EDGER TRAY

CROSS REFERENCE TO RELATED APPLICATIONS

This application is based on provisional application 60/319,459 filed Aug. 9, 2002.

BACKGROUND OF INVENTION

This invention relates to a paint tray for paint edger trimmers and particularly to a uniquely shaped tray having a spout at one end to save and pour paint. In the prior art, edger trimmers or pad painters have generally been used with conventional roller trays. These paint trays are rather large, difficult to hold in one hand and unsatisfactory for use with edgers. The edger trimmers have a tendency to pick up too much paint, which is a problem in doing delicate edging. Further, the invention includes both a distribution area and a wiping area spaced from the wall of the tray to insure the proper amount of paint on the pad and to prevent paint build-up on the edge of the tray. Using conventional roller paint trays also requires additional time and concentration.

Typical patents and publications showing the state of the prior art are U.S. Pat. Nos. 5,553,228; 5,316,137; D448,130, and US 2002/0056714.

U.S. Pat. No. Publication US 2002/0056714 discloses a roller paint tray with a handle and spout and ridge ribbing along the inclined tray base leading into a paint reservoir.

U.S. No. 5,316,137 to Kyllonen discloses a paint roller tray and lid having a seal for saving paint and a roller handle holder thereon.

U.S. Pat. Nos. 5,533,228 and 5,553,701 both show resealable paint trays with an inclined ramp extending upwardly from the base.

The prior art does not show applicant's unique design for a resealable tray for edger trimmers, which facilitates the difficult job of edging. With applicant's tray, it is possible to place the desired amount of paint on the edger in a quick and expeditious manner. An internal wiping ledge wipes off excess paint at the end of a ramp while ridges on the ramp distribute the paint on the pad. There is little chance that the edger will become overloaded or submerged in the paint and the smaller size tray facilitates ease of handling. A pouring spout at a forward corner of the tray permits savings the paint when the job is over and a lid preserves the paint during lulls in the job.

SUMMARY OF INVENTION

This invention comprises a uniquely shaped tray particularly suited for edger trimmers, which includes a bottom portion having a base with upwardly extending walls about its periphery and an inclined distribution platform or ramp extending upwardly from the base at a spaced interval from a rear wall. The distribution ramp includes a plurality of spaced raised portions or chevron shaped ridges that distribute the paint on the edger pad. A spout is formed in the corner of a forward wall to save and pour paint that accumulates on the base. Side walls join the forward and rear wall. A cover is provided which fits over and sealingly engages a flange portion of the walls on the bottom portion in a secure fit.

The tray is slightly larger than the diameter of a paint edger trimmer and may be conveniently held in one hand while edging. The edger pad contacts the array of chevron shaped ridges on the inclined distribution ramp to distribute paint on the pad and is wiped on a vertical ledge at the top of the ramp. The excess paint flows downwardly from the ledge along the platform and behind the platform to the base. The ledge is spaced from the rear wall of the tray in order to eliminate paint buildup on the forward wall of the tray.

Accordingly, an object of this invention is to provide a new and improved paint tray particularly for edger trimmers.

Another object of this invention is to provide a new and improved paint tray for edger trimmers having a removable sealing top and a pouring spout at one end of the tray, which also facilitates holding the tray.

A further object of this invention is to provide a new and improved relatively small paint tray for edge trimmers having an integral ramp with chevron shaped raised ridges extending upwardly at an angle from the base for distributing paint on the edger pad.

A still further object of this invention is to provide a new and improved paint tray for pad painters, which includes an inclined ramp spaced from the tray walls and having an upper ledge to wipe excess paint from the pad, which then flows back into the tray.

A more specific object of this invention is to provide a new and improved paint edger tray having an integrally molded inclined surface with a spaced array of raised ridges thereon each inclined from the center.towards both edges to distribute paint on the pad, said inclined surface being spaced from the walls of the tray and including an upper ledge to remove excess paint which flows back into the base of the tray a pouring spout on an opposite wall and a removable top cover for sealing the tray.

BRIEF DESCRIPTION OF DRAWINGS

The above and other objects and advantages of this invention may be more clearly seen when viewed in conjunction wit the accompanying drawings wherein.

FIG. 3 is a bottom view of the bottom portion of the edger trimmer tray; and.

DETAILED DESCRIPTION

Figure 1:
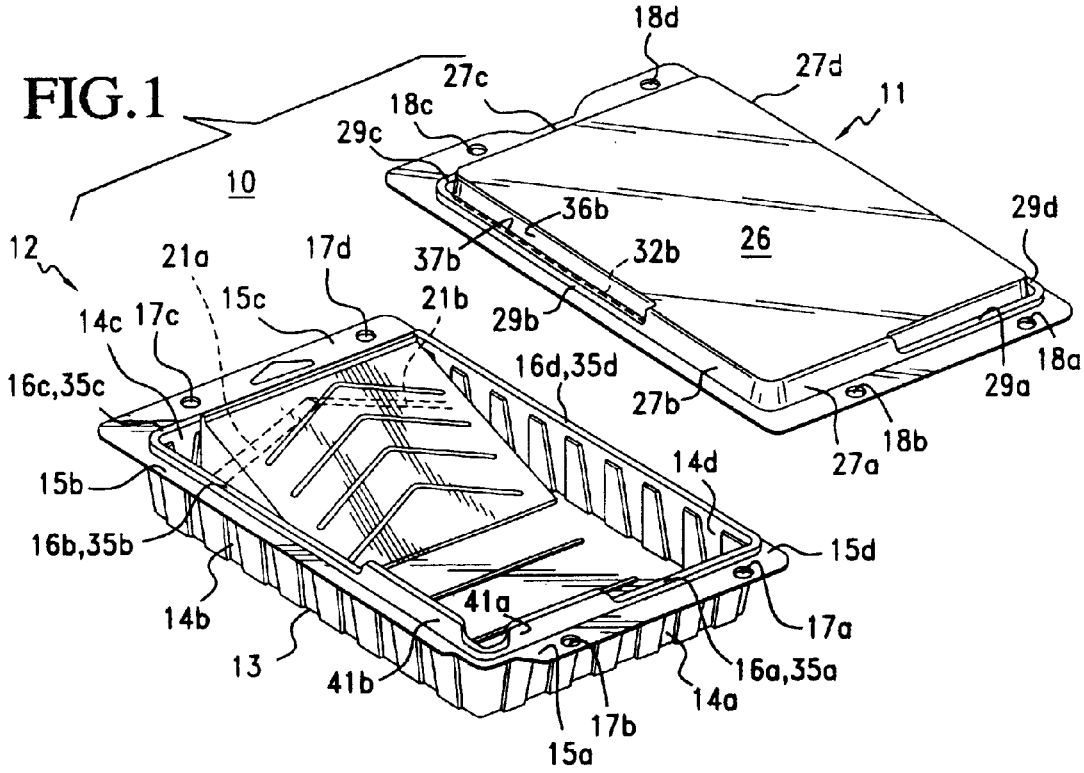
FIG. 1 is a perspective view of the unique paint tray for edger trimmers including the top and bottom portions.
Figure 4:
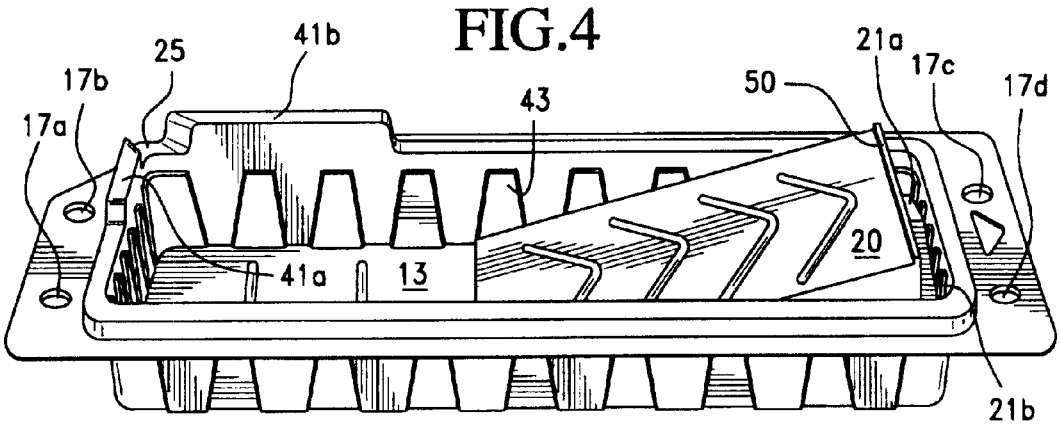
FIG. 4 is a side perspective view of the bottom portion of the edger trimmer tray.
Figure 2:
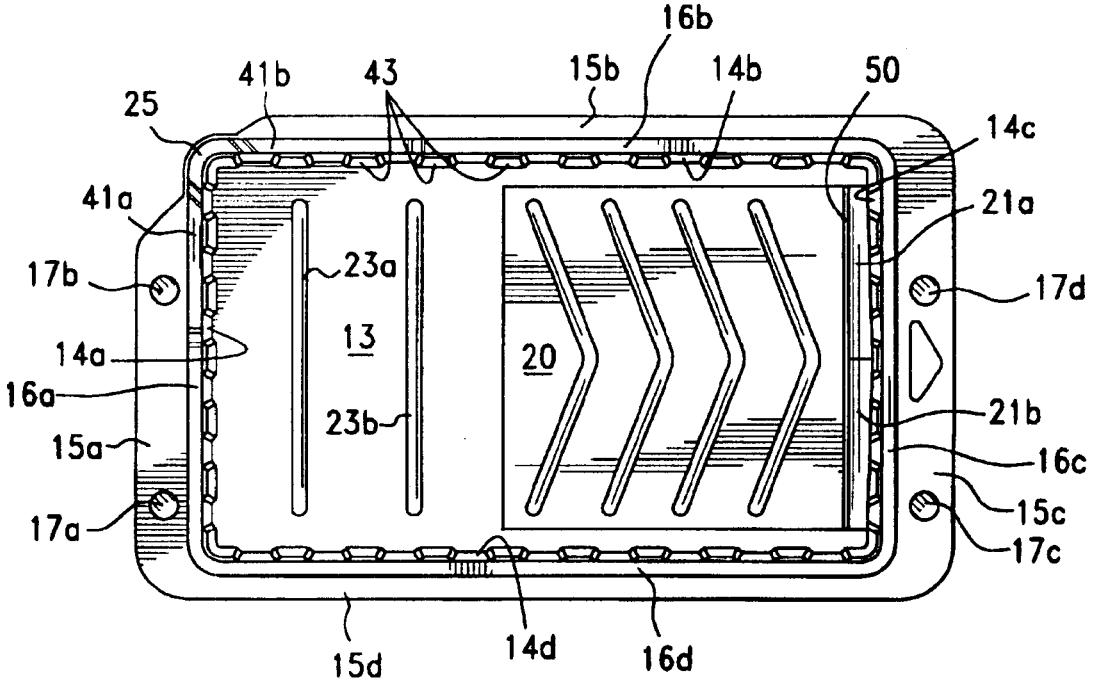
FIG. 2 is a top view of the bottom portion of the paint tray.
Figure 3:
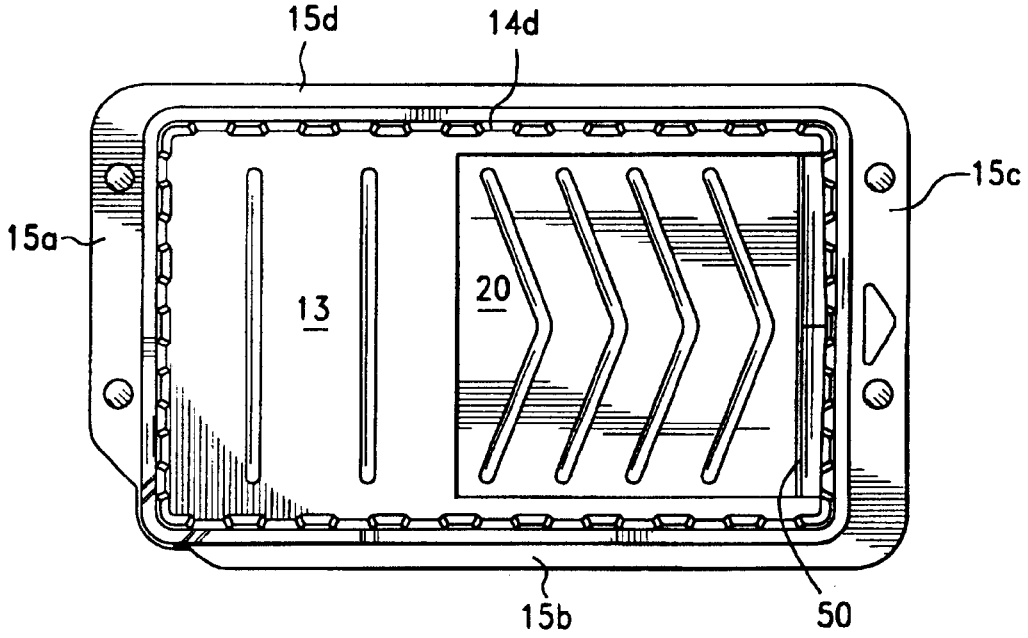

Referring now to the drawings and particularly to FIGS. 1 and 2, the invention comprises an edger trimmer tray 10 having a top or cover portion 11 and a bottom or tray portion 12. The tray portion 12 includes a base 13 and upwardly extending walls 14*a–d*. Flanges 15*a–d* extend perpendicularly outward from the walls 14*a–d* at a slight distance downwardly from the upper ledges 16*a–d* of walls 14*a–d*. The flanges 15*a* and 15*c* extend further outwardly than flanges 15*b* and 15*d*. The flanges 15*a* and 15*c* includes recesses 17*a–d* that mate with projections 18*a* 18*c* respectively in the top cover 11 to secure the top cover 11 on the tray portion 12.

The cover 11 includes an upper surface 26 with downwardly extending walls or sides 27*a–d*, which terminate in rounded edges 32*a–d* at the lower portion of a channel 34. The channel 34 extends outwardly and then upwardly from the sides 27*a–d* terminating in flanges 29*a–d*. The channel 34 includes downwardly extending inner sides 36*a–d* and outer sides 37*a–d*, which terminate in outwardly extending flanges 29*a–d*. The channel 34 mates internally with the raised portions 35*a–d* of the tray 12 while the projections

18*a–d* engage recesses 17*a–d* to form a seal about the tray 10. Adjoining portions 41*a* and 41*b* of walls 27*a* and 27*b* extend directly to flanges 29*a* and 29*c* without a channel 34 to accommodate extending side portions 41*a–b*.

The tray portion 12 as shown in FIG. 2 includes an inclined platform or ramp 20 extending upwardly from approximately the mid-point of the base 13 to a point spaced from wall 14*c*. The inclined ramp 20 extends vertically above the walls 14*a–d* terminating in a vertical ledge 50. The space between the inclined ramp 20 with ledge 50 and the wall 14*c* includes surfaces 21*a* and 21*b* sloping downwardly on opposite sides of the ramp midpoint to direct excess paint flow back into the base 13. Thus, excess paint is removed by the ledge 50 and flows back into the tray 12 rather than flowing over the wall 14*c* as in the prior art. An array of spaced chevron projections is located on the ramp 20 to distribute paint on the edger pad during use. The base 13 also includes transverse ridges 23*a, b* for paint distribution. Shaped indentations 43 are positioned at intervals along the walls 14*a–d*.

A spout 25 is located on the corner of wall 14*a* and 14*c* opposite the ramp 20. The spout 25 includes side wall portions 41*a–b*, which extend outwardly from the wall 14*a* and 14*c*. This spout 25 facilitates saving paint or removing excess paint from the tray 10. Further, the spout 25 facilitates holding the tray 10 in one hand with a thumb in the spout 25. The entire bottom tray 12 as well as the cover 11 may each be integrally molded of plastic in an inexpensive operation.

Thus, the edger trimmer tray 10 provides a ramp 20 for distributing the paint on a conventional edger trimmer, pad painter or mini-roller (not shown). The ledge 50 eliminates the problem of having excess paint on the pad. In contrast to the other trays, the ledge 50 is spaced form the tray wall 14*c* so excess paint flows back into the tray 10 rather than accumulating on wall 14*c* and flowing out of the tray 10. The rather small tray 10 can be held with a thumb on the spout 25 in one hand while the edging is done with the other hand thus speeding up the operation. At the end of a job, the excess paint may be poured out of the spout 25. The cover 11 may be placed over the bottom tray 13 to protect the paint from drying or developing a skin on the surface. The invention may also be used with mini-paint rollers, brushes with bristles and foam brushes. The invention generally used with four (4) inch pads but the design may be employed with seven (7) or nine (9) inch pads.

While the invention has been explained by a detailed descript of certain specific embodiments, it is understood that various modifications and substitutions can be made in any of them within the scope of the appended claims that are intended also to include equivalents of such embodiments.

What is claimed is:

1. A paint tray for holding paint to be applied to an edger trimmer comprises:

a base portion having a forward wall, a rear wall and side walls joining the forward and rear walls and being spaced apart a distance slightly larger than the edger trimmer, said walls extending upwardly from the base and having substantially the same height;

a raised portion of one of the side walls and the rear wall extending further upwardly;

a spout formed between the raised portions of the rear wall and side wall for pouring paint from the tray; and, a ramp;

a ledge at one end of the ramp for wiping paint from the edger trimmer.

2. A paint tray in accordance with claim 1 wherein:

the base portion further includes a plurality of spaced transverse ridges extending substantially between the side walls.

3. A paint tray in accordance with claim 1 wherein:

the ramp includes a vertical ledge at one end extending beyond the side of the tray and being spaced from the front walls of the base said ramp extending upwardly at the other end at an angle from approximately the midpoint of the base to the ledge, said ramp also being spaced from the side walls and terminating at a height above the base walls, said ledge wiping excess paint from the edger trimmer to flow downwardly into the base portion.

4. A paint tray in accordance with claim 1 further including:

a top portion which sealingly engages the base portion of the tray.

5. A paint tray in accordance with claim 1 wherein:

the side walls and front and rear walls each include an upper lip having an outer portion extending downwardly for a predetermined distance an end portion on said outer portion and a flange extending perpendicularly outwardly from the end portion, the flanges on the front and rear walls each including a plurality of recesses therein and being larger than the side flanges.

6. A paint tray in accordance with claim 4 further including:

a top portion including a substantially rectangular surface having downwardly extending front, rear and side walls, an end portion on said walls, a peripherally recessed base extending outwardly from the end portion of said walls, a raised lip forming the opposite side of the recess, a downwardly extending outer portion on said lip and a flange extending perpendicularly outward from the downwardly extending portion on the front, rear and side walls.

7. A paint tray in accordance with claim 6 wherein:

the flanges extending from the front and rear walls of the top portion are larger and include a plurality of downwardly extending projections to engage the flange recesses in the base portion sealing the paint in said tray.

8. A paint tray in accordance with claim 1 wherein:

the spout comprises a raised portion of the rear wall and a raised portion of the side wall having a space therebetween at one rear corner of the tray, said spout also providing a thumb hole for gripping the base portion with one hand.

9. A paint tray in accordance with claim 1 further including:

an inclined portion located between the ramp and the rear wall comprising first and second inclined surfaces extending upwardly from lower portions of the ramp on opposite sides thereof, said surfaces meeting below the height of the rear wall and below the wiping ledge to permit excess paint to flow into the base.

10. A paint tray in accordance with claim 1 wherein:

the front, rear and side walls include a plurality of inwardly projecting protrusions.

11. A paint tray in accordance with claim 1 wherein:

the tray is small enough to be held in one hand, said spout providing a thumb grip.

12. A paint tray for holding paint to be applied to an edger trimmer in accordance with claim 1 wherein:

the tray sides are spaced to accommodate an edger trimmer ranging from 4 to 8 inches.

13. A paint tray in accordance with claim 1 wherein:

the paint may be applied to a paint roller or brush.

14. A paint tray in accordance with claim 1 further including:

a ramp spaced from the walls and extending upwardly from the base at an angle at one end and having a plurality of spaced ridges thereon to distribute paint on the edge trimmer, a paint roller or paint brush.

* * * * *